US009434579B2

(12) United States Patent
Arai et al.

(10) Patent No.: US 9,434,579 B2
(45) Date of Patent: Sep. 6, 2016

(54) ELEVATOR DEVICE AND ROLLER GUIDE ASSEMBLY

(75) Inventors: Hideki Arai, Tokyo (JP); Takami Koyama, Tokyo (JP); Tsuyoshi Sekine, Tokyo (JP); Hideki Nakano, Tokyo (JP)

(73) Assignee: OTIS ELEVATOR COMPANY, Farmington, CT (US)

( * ) Notice: Subject to any disclaimer, the term of this patent is extended or adjusted under 35 U.S.C. 154(b) by 123 days.

(21) Appl. No.: 14/125,381

(22) PCT Filed: May 30, 2012

(86) PCT No.: PCT/IB2012/001052

§ 371 (c)(1),
(2), (4) Date: Dec. 11, 2013

(87) PCT Pub. No.: WO2012/172400

PCT Pub. Date: Dec. 20, 2012

(65) Prior Publication Data

US 2014/0102833 A1 Apr. 17, 2014

(30) Foreign Application Priority Data

Jun. 15, 2011 (JP) ..... 2011-132828

(51) Int. Cl.
*B66B 7/04* (2006.01)

(52) U.S. Cl.
CPC ..... *B66B 7/046* (2013.01); *B66B 7/048* (2013.01)

(58) Field of Classification Search
CPC ..... B66B 7/046; B66B 7/048; B66B 7/022; B66B 7/042
USPC ..... 187/410
See application file for complete search history.

(56) References Cited

U.S. PATENT DOCUMENTS 3,329,240 A * 7/1967 Harwood et al. ..... 187/410
5,107,963 A * 4/1992 Rocca et al. ..... 187/410
5,303,450 A * 4/1994 Lange ..... 16/35 D
5,950,771 A 9/1999 Ferrisi et al.
5,984,053 A 11/1999 Lee et al.

(Continued)

FOREIGN PATENT DOCUMENTS

CN 1188068 A 7/1998
CN 1448329 A 10/2003

(Continued)

OTHER PUBLICATIONS

Notification of Transmittal of the International Search Report and the Written Opinion of the International Searching Authority, or the Declaration, PCT/IB2012/001052, Dec. 26, 2012, 5 pages.

(Continued)

*Primary Examiner* — William E Dondero
*Assistant Examiner* — Diem Tran
(74) *Attorney, Agent, or Firm* — Cantor Colburn LLP

(57) ABSTRACT

An exemplary roller guide assembly for an elevator device comprises a shaft supporting a roller for engaging a guide rail, a shaft support member that receives the shaft therein, and a member inserted between the shaft and the aforementioned shaft support member. According to this invention, because the shaft is supported by the shaft support member via the elastic member, when the rollers are biased in the horizontal direction by the guide rail, the member limits the shaft from turning relative to the shaft support member.

8 Claims, 5 Drawing Sheets

(56) References Cited

U.S. PATENT DOCUMENTS

| | | | | |
|---|---|---|---|---|
| 6,345,698 | B1 * | 2/2002 | Ravishankar | 187/410 |
| 2003/0183457 | A1 | 10/2003 | Maury et al. | |
| 2006/0032724 | A1 | 2/2006 | Kanaris et al. | |

FOREIGN PATENT DOCUMENTS

| | | | |
|---|---|---|---|
| CN | 101146732 | A | 3/2008 |
| EP | 0931752 | A1 | 7/1999 |
| JP | 2004059205 | A | 2/2004 |
| KR | 2019990022587 | | 10/1999 |
| WO | 2012172400 | A2 | 12/2012 |
| WO | WO 2013170532 | A1 * | 11/2013 |

OTHER PUBLICATIONS

Chinese Search Report for application CN 201280029082.1, dated Feb. 27, 2015, 3 pages.

European Search Report for application PCT/IB2012/001052, dated Jan. 7, 2015, 7 pages.

* cited by examiner (a)

(b)

ELEVATOR DEVICE AND ROLLER GUIDE ASSEMBLY

BACKGROUND

The present invention pertains to an elevator device and a roller guide assembly, specifically, to an improved roller guide that is attached to a car so as to guide the car in the vertical direction along a rail.

A conventional elevator is equipped with a drive means for moving a car up and down along a hoistway and a guide means for preventing the car from becoming displaced or tilted within a plane in order to move the car up and down stably. As for the configuration of the aforementioned drive means, a drive machine is provided at the top of the hoistway, hoist ropes are placed around said drive machine, and the car is suspended at one end of said rope while a counterweight is suspended at the other end so as to balance them, whereby the car and the counterweight are moved up and down in the opposite directions through traction as the drive machine is driven. In addition, the aforementioned guide means comprise a pair of guide rails that are provided near outer side surfaces of the car at opposite positions on the hoistway, and multiple roller guide assemblies that are provided with rollers that contact the respective guide rails and which are positioned above and below the car near its side surfaces.

Japanese Patent No. 4050466 describes a conventional elevator device. As shown in FIG. 1, in this elevator device, the hoistway is provided with pairing guide rails 16 along the vertical direction. On the other hand, 4 roller guide assemblies 20 are provided at lateral positions above and below car 12. As shown in FIG. 2, each roller guide assembly 20 is equipped with 3 rollers 22 that engage with guide rail 16, and each roller 22 is provided in a horizontally swingable manner. That is, rotary shaft 34 is provided on base 40 in a rotatable manner; the base end part of lever arm 26, which protrudes upward, is connected to one end of said rotary shaft 34; rollers 22 are supported in a rotatable manner at the front end part of said lever arm 26 via arm end 30 and roller shaft 24; and suspension assembly 42 is provided so as to bias said rollers 22 toward guide rail 16. In addition, friction damping assembly 44 serving as a damper is provided at the other end of rotary shaft 34.

Elevator system and component designers face the ongoing challenges of reducing costs of elevator systems and components, and fitting elevator systems and components within tighter space constraints. In many circumstances, these objectives can be considered incompatible and unattainable without significant innovation.

SUMMARY OF THE INVENTION

In one arrangement, the invention is a roller guide assembly that is provided in an elevator device that is equipped with a hoistway that is formed along the vertical direction, a car that is moved up and down along said hoistway, guide rails that guide the roller guide assemblies when the aforementioned car provided along the aforementioned hoistway is moved up and down, and multiple roller guide assemblies that are provided on the aforementioned car and guided by said guide rails; wherein, said roller guide assembly for an elevator device comprises a shaft supporting a roller for engaging a guide rail, a shaft support member that receives the shaft therein, and a member inserted between the shaft and the aforementioned shaft support member, wherein the member limits the shaft from turning relative to the shaft support member.

In one possible alternative, the member is tubular.

In this arrangement, because the shaft is supported by the shaft support member via the tubular elastic member, when the rollers are biased in the horizontal direction by the guide rail, a turning force is acted upon the shaft. Because the shaft, the elastic member, and the shaft support member are restrained from turning relative to each other at the boundary parts of these members, the outer peripheral part of the elastic member is fixed, so the turning force from the shaft is acted upon its inner peripheral part. As such, although the elastic member becomes twisted due to the torsional force applied, it returns to its original position as the torsional force is no longer subsequently applied. When the rollers travel over steps formed at joint parts of the guide rails, because the rollers are biased toward the guide rails due to the elastic force of the elastic member, the car is restrained from vibrating. In the event of an unbalanced load due to an unbalanced cargo inside the car, because the car is supported by the guide rails while the elastic members are being twisted, no excessive force is applied to the car, so the car can be restrained from tilting; and the elastic members recover from their twisted state subsequently as the effect of the unbalanced load becomes no longer present. These elastic members achieve a biasing function for biasing the rollers toward the guide rails, a damper function for restraining the biased rollers from reciprocating in the biasing direction repeatedly, and a bearing function for supporting the rollers.

Additionally or alternatively with any of the arrangements, the outer peripheral surface of the aforementioned shaft, the inner and the outer peripheral surfaces of the aforementioned elastic member, and the inner peripheral surface of the aforementioned shaft support member are formed in a circular cross-sectional shape or a polygonal cross-sectional shape; whereby, the polygon formed on the inner and the outer peripheral surfaces of the aforementioned respective members functions as the aforementioned restraining means.

In this arrangement, because the polygonal outer peripheral surface is fitted to the polygonal inner peripheral surface, turning of the elastic member with respect to the shaft support member is restrained, and turning of the shaft with respect to said elastic member is restrained. Thus, the elastic member becomes twisted when a turning force is acted upon said shaft, and it returns to its original position subsequently.

Additionally or alternatively with any of the arrangements, the outer peripheral surface of the aforementioned shaft, the inner and the outer peripheral surfaces of the aforementioned elastic member, and the inner peripheral surface of the aforementioned shaft support member are formed in a circular cross-sectional shape.

Additionally or alternatively with any of the arrangements, the one or more concave parts or recesses are formed either on the inner peripheral surface or on the outer peripheral surface at the boundary parts of the aforementioned shaft, the aforementioned elastic member, and the aforementioned shaft support member while convex parts or projections are formed on the other peripheral surface.

In this arrangement, because the projections are received in the recesses, turning of the elastic member with respect to the shaft support member is restrained, and turning of the shaft with respect to said elastic member is restrained. Thus, the elastic member becomes twisted when a turning force is acted upon said shaft, and it returns to its original position subsequently.

Additionally or alternatively with any of the arrangements, an adhesive is applied at the boundary parts of the aforementioned shaft, the aforementioned elastic member, and the aforementioned shaft support member so as to bond the respective members together in order to configure the restraining means.

In this arrangement, because the respective members are bonded together at the boundary parts, turning of the elastic member with respect to the shaft support member is restrained, and turning of the shaft with respect to said elastic member is restrained. Thus, the elastic member becomes twisted when a turning force is acted upon said shaft, and it returns to its original position subsequently.

Additionally or alternatively with any of the arrangements, the roller guide assembly includes three rollers, and each roller includes a corresponding shaft, shaft support member and tubular member.

In this arrangement, said roller guide assembly is equipped with three rollers, i.e. pairing rollers that sandwich rail body of guide rail and single roller that is provided on the inner side of pairing rail body so as to roll on the facing surface of rail body.

Additionally or alternatively with any of the arrangements, the roller guide assembly is mounted to a car of the elevator system.

When said rollers are provided at the four positions of car, displacement of car within a plane and tilting of car in all directions can be restrained. The present invention is also useable in frameless car configurations, in which one or more of the car panels also act as a structural member. In such an arrangement, for example, the frame members would also function as a car panel (e.g. occupants of the car can see the frame members) and the roller guide assemblies would mount to the frame members.

Additionally or alternatively with any of the arrangements, the roller guide assembly is mounted to a counterweight of the elevator system.

In this arrangement, the roller guide assembly is provided along the hoistway at positions corresponding to side surfaces of the counterweight, and multiple roller guide assemblies could be provided at positions near the side surfaces at the top and bottom of the counterweight for guiding the counterweight along the guide rails in order to move the counterweight without causing displacement or tilting of the counterweight within a plane.

In another arrangements, an elevator system that is equipped with a hoistway that is formed along the vertical direction, a car that is moved up and down along said hoistway, guide rails that guide a roller guide assemblies when the aforementioned car provided along the aforementioned hoistway is moved up and down, and guided by the aforementioned guide rails; wherein, said elevator system comprises a car and/or a counterweight, and a roller guide assembly mounted to the car and/or counterweight, the roller guide assembly comprising: a shaft supporting a roller for engaging a guide rail; a shaft support member that receives the shaft therein; and a member inserted between the shaft and the aforementioned shaft support member, wherein the member limits the shaft from turning relative to the shaft support member.

In this arrangement, because the shaft is supported by the shaft support member via the tubular elastic member, a turning force is acted upon the shaft when the rollers are swung as they are pushed in the horizontal direction by the guide rail. Because the shaft, the elastic member, and the shaft support member are restrained from turning relative to each other at the boundary parts of these members, the outer peripheral part of the elastic member is fixed, so the turning force from shaft is acted upon its inner peripheral part. As such, although the elastic member becomes twisted due to the torsional force applied, it returns to its original position as the torsional force is no longer subsequently applied. When the rollers travel over steps formed at joint parts of the guide rails, because the rollers are biased toward the guide rails due to the elastic force of the elastic member, the car and/or counterweight is restrained from vibrating. In the event of an unbalanced load due to an unbalanced cargo inside the car, because the car is supported by the guide rails while the elastic members are being twisted, no excessive force is applied to the car, so the car can be restrained from tilting; and the elastic members recover from their twisted state subsequently as the effect of the unbalanced load becomes no longer present. These elastic members achieve a biasing function for biasing the rollers toward the guide rails, a damper function for restraining the biased rollers from reciprocating in the biasing direction repeatedly, and a bearing function for supporting the rollers.

DETAILED DESCRIPTION

Various exemplary arrangements of the elevator device and the roller guide assembly in accordance with the present invention will be explained below.

Figure 4:
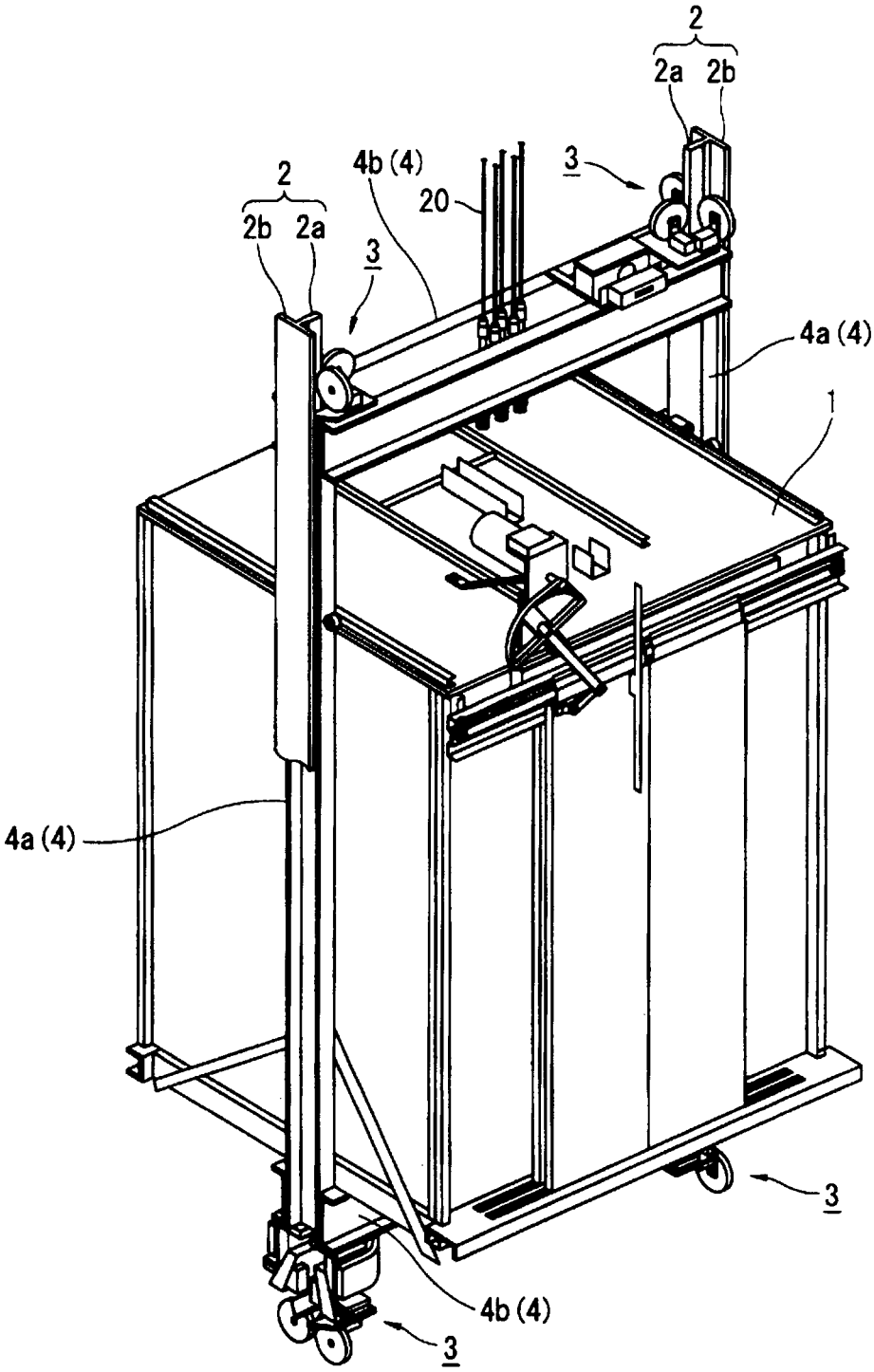
FIG. 4 is a perspective view of one possible arrangement of an elevator device.
Figure 5:
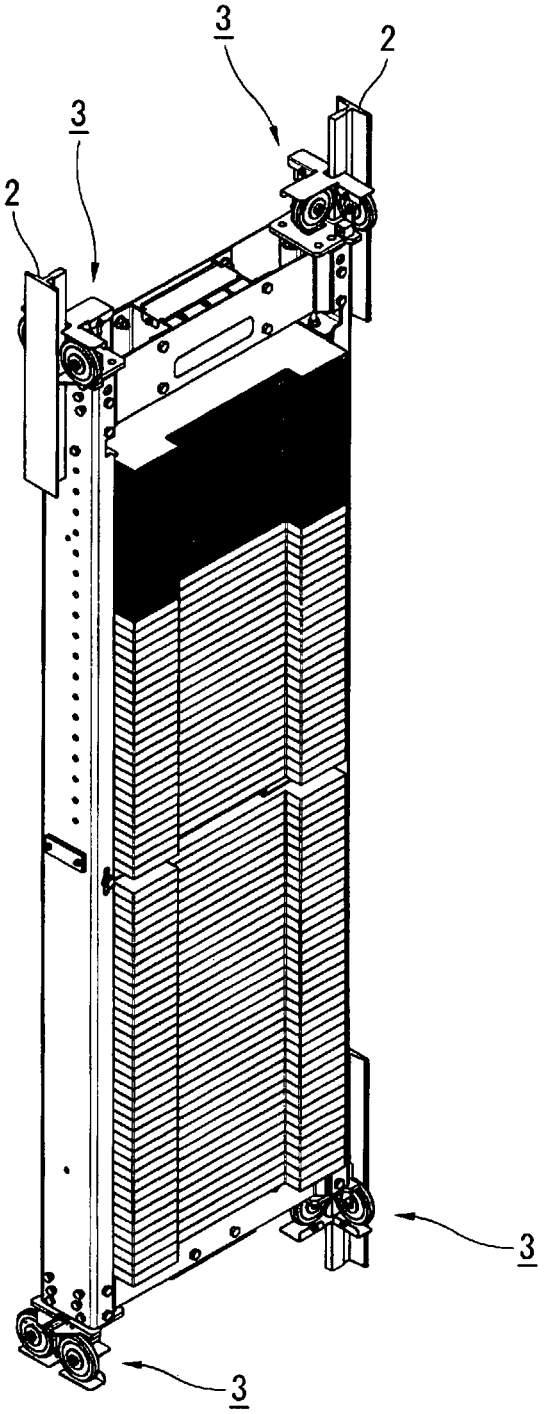
FIG. 5 is a perspective view of one possible arrangement of a counterweight with roller guides in accordance with the present invention.

As shown in FIG. 4, a hoistway (not shown) is formed along the vertical direction, and car 1 that is moved up and down along said hoistway is provided. Car 1 is suspended by one or more hoisting elements, such as the wire rope 20 provided in the figure or a coated steel belt (not shown). A counterweight (not shown) can also be suspended by the wire ropes 20. Although other roping arrangements are possible, in the 1:1 roping arrangement shown in the figure one end of the wire ropes 20 secure to the car 1 and the other end of said wire ropes 20 secure to the counterweight so as to balance their weights. The elevator system also includes guide rails 2. A pair of guide rails 2 could be provided along the hoistway at positions corresponding to side surfaces of car 1; and multiple roller guide assemblies 3, which are used for guiding car 1 along guide rails 2 and 2, are provided at positions near the side surfaces above and below aforementioned car 1 in order to move car 1 without causing displacement or tilting of car 1 within a plane. Similarly, as shown in FIG. 5, another pair of guide rails could be provided along the hoistway at positions corresponding to side surfaces of the counterweight; and multiple roller guide assemblies 3 could be provided at positions near the side surfaces at the top and bottom of the counterweight for guiding the counterweight along the guide rails 2 in order to move the counterweight without causing displacement or tilting of the counterweight within a plane. Other components of the elevator system that are not relevant to the present invention (e.g. safeties, governor assembly, etc.) will not be discussed.

The aforementioned guide rails 2 comprises rail body 2*a* and retainer part 2*b* for retaining said rail body 2*a* and has a quasi-T-shaped cross-section. The pair of guide rails 2 and 2 for the car 1 are provided with rail bodies 2*a* facing each other. The pair of guide rails 2 and 2 for the counterweight are provided with rail bodies 2*a* facing each other, although these guide rails are not necessarily facing the same direction as the car guide rails depending on the hoistway and elevator system arrangement.

The car 1 can be provided with traveling frame 4 so as to surround car 1 in the vertical direction. Said traveling frame 4 comprises two vertical frames 4*a*, two top frames 4*b*, and two bottom frames 4*b*; wherein, right and left vertical frames 4*a* and bottom frames 4*b* are provided in contact with the side surfaces and the bottom surface of car 1, and top frames 4*b* are provided at a position slightly away from the top surface of car 1. Right and left vertical frames 4*a* have a quasi-U-shaped cross section with the opening part facing outward, the two top frames 4*b* and two bottom frames 4*b* have a quasi-T-shaped cross section with the opening part facing upward or downward, and the two top frames 4*b* and two bottom frames 4*b* are connected together while sandwiching right and left vertical frames 4*a* respectively.

Figure 3:
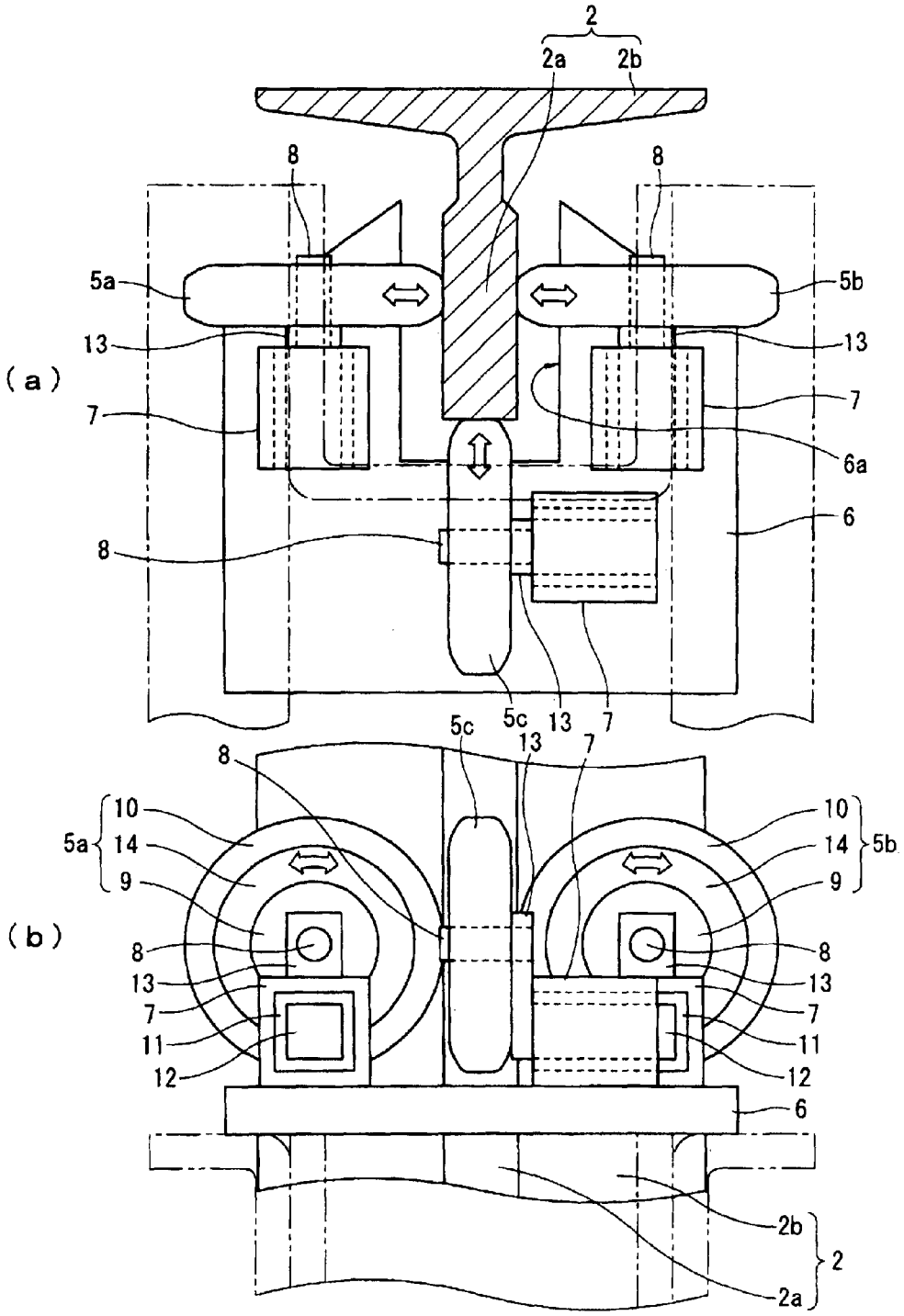
FIG. 3 shows one possible arrangement of a roller guide assembly; wherein, (a) is a plan view, and (b) is a front view.

Roller guide assemblies 3 are provided at both end positions of aforementioned two top frame members 4*b* and two bottom frame members 4*b*. As shown in FIG. 3, said roller guide assembly 3 is equipped with pairing rollers 5*a* and 5*b* that sandwich rail body 2*a* of guide rail 2 and single roller 5*c* that is provided on the inner side of pairing rail body 2*a* so as to roll on the facing surface of rail body 2*a*. When said rollers 5*a*, 5*b*, and 5*c* are provided at the four positions of car 1, displacement of car 1 within a plane and tilting of car 1 in all directions can be restrained. The present invention is also useable in frameless car configurations, in which one or more of the car panels also act as a structural member. In such an arrangement, for example, the frame members 4*a*, 4*b* would also function as a car panel (e.g. occupants of the car can see the frame members) and the roller guide assemblies 3 would mount to the frame members 4*a*, 4*b*.

One possible configuration of roller guide assembly 3 will be explained. As shown in FIG. 3(*a*), base member 6 is connected to respective end positions of top frames 4*b* and bottom frames 4*b* that constitute aforementioned traveling frame 4. Notch part 6*a* is formed on said base member 6 so as to accommodate rail body 2*a* of guide rail 2. That is, rail body 2*a* part of guide rail 2 is placed inside the quasi-U-shaped cross section of vertical frame 4*a* of aforementioned traveling frame 4, and aforementioned notch part 6*a* is created in order for base member 6 to stay away from said rail body 2*a*.

Figure 1:
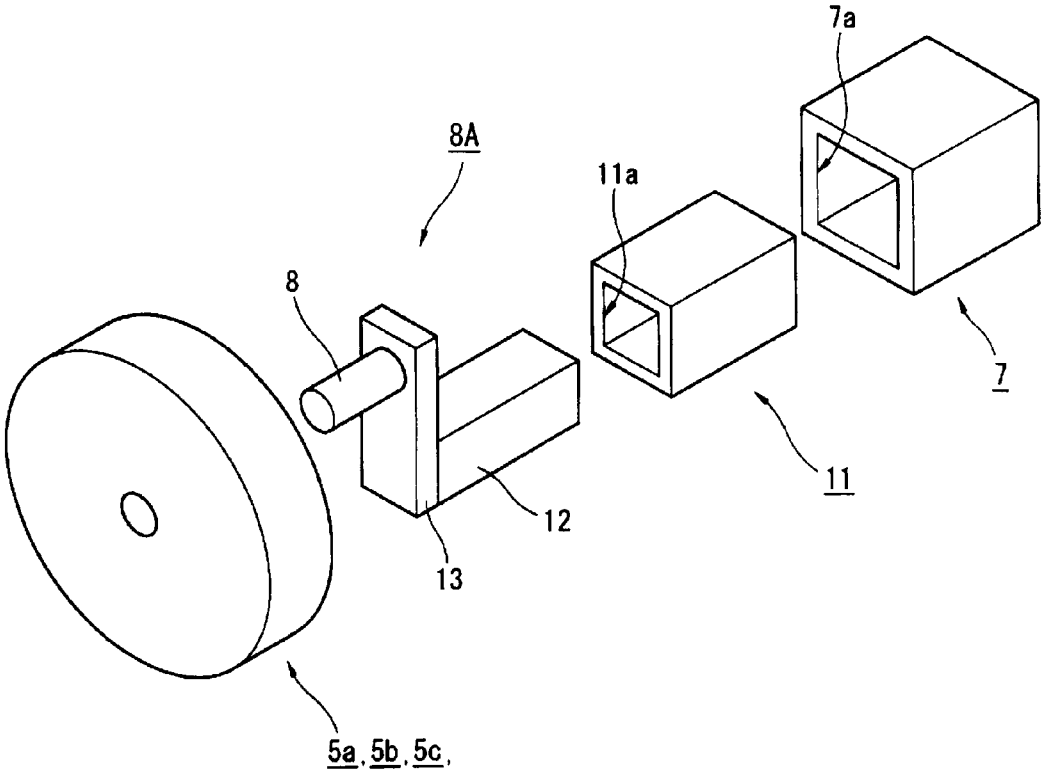
FIG. 1 is a perspective view showing one possible arrangement of a swing mechanism of a roller guide assembly.

Aforementioned rollers 5*a*, 5*b*, and 5*c*, which roll on guide rail 2, are supported on aforementioned base member 6. That is, three shaft support members 7 are provided upright on base member 6; the respective shaft support member 7 is provided with shaft 8A that faces aforementioned guide rail 2 and can have a horizontal orientation. Said shaft 8A comprises a spindle 8, root portion 12 and arm 13; wherein the spindle 8, which also can have a horizontal orientation, is provided via arm 13 that protrudes above one end of root portion 12; and rollers 5*a*, 5*b*, and 5*c* are supported in a rotatable manner by said spindles 8 respectively. The relationship among these members is shown in the perspective view in FIG. 1. Other configurations, however, are also possible.

Next, one possible configuration of aforementioned rollers 5*a*, 5*b*, and 5*c* will be explained. Because aforementioned rollers 5*a*, 5*b*, and 5*c* can have the same configuration, only roller 5*a* will be explained. Roller 5*a* comprises annular roller periphery 10, roller support part 14 that is fitted inside said annular roller periphery 10, and bearing 9 that is fitted inside said roller support part 14. Aforementioned roller periphery 10 is made of a suitable flexible material such as elastic like rubber or urethane. Aforementioned bearing 9 can have a conventional configuration in that multiple steel balls placed between an inner wing and an outer ring.

Next, configuration of the part that supports aforementioned shaft 8A will be explained based on FIG. 2(*a*). This part can be configured in the same manner for all rollers 5*a*, 5*b*, and 5*c*. Insertion hole 7*a* is created on aforementioned shaft support member 7, a member 11, made for example from rubber or other suitable materials such as urethane, serving as an elastic member is inserted in said insertion hole 7*a*, and aforementioned root portion 12 of the shaft 8A is inserted inside 11*a* of said member 11. In one embodiment, member 11 is a tubular member 11.

In addition, the support part is configured such that shaft 8A, tubular member 11, and shaft support member 7 have limited rotational movement relative to each other. That is, the outer peripheral surface of aforementioned root portion 12, the inner peripheral surface of aforementioned tubular member 11, and the inner peripheral surface of aforementioned shaft support member 7 are formed in a polygonal cross-sectional shape, that is, a square in the present embodiment; and the polygon formed on the inner peripheral surfaces of the respective members functions as a restraining means that restrains the respective members from turning relative to each other. Because aforementioned tubular member 11 and aforementioned shaft support member 7 may need to be joined more firmly, cure adhesion could be utilized in addition to the fitting of the square cross sections together.

According to this invention, because root portions 12 of the shaft 8A are supported by shaft support members 7 via tubular members 11, when rollers 5*a*, 5*b*, and 5*c* are pushed by guide rails 2 to swing, turning forces are applied to root portions 12 via arms 13. Because turning of root portions 12 and tubular members 11 relative to each other at the boundary parts of these members is restrained, the outer peripheral surfaces of tubular members 11 are fixed, and the turning forces from root portions 12 are applied to their inner peripheral surfaces. Thus, although tubular members 11 become twisted due to torsional forces, they return to their original positions as the torsional forces are no longer subsequently applied. When rollers 5*a*, 5*b*, and 5*c* travel over steps formed at joint parts of guide rails 2, because rollers 5*a*, 5*b*, and 5*c* are biased toward guide rails 2 due to the elastic forces of tubular members 11, car 1 is restrained from vibrating; and in the event when an unbalanced load is applied to car 1 for example due to an unbalanced cargo inside car 1, since car 1 is supported by guide rails 2 while tubular members 11 are being twisted, no excessive force is acted upon rollers 5*a*, 5*b*, and 5*c*, so car 1 can be restrained from tilting; and tubular members 11 recover from their twisted state subsequently as the effect of the unbalanced load becomes applicable. Said tubular members 11 achieve a biasing function for biasing rollers 5*a*, 5*b*, and 5*c* toward guide rails 2, a damper function for restraining biased rollers 5*a*, 5*b*, and 5*c* from reciprocating in the biasing direction repeatedly, and a bearing function for supporting rollers 5*a*, 5*b*, and 5*c*.

According to this elevator device and the roller guide assembly, because tubular member 11 is placed between root portions 12 and shaft support member 7 of the swing mechanism in order to provide the restraining means for restraining these members from turning relative to each other at their boundary part, the twisting of tubular member 11 when the lateral force is acted upon shaft 8A and its subsequent returning to its original position as the lateral force is no longer applied are repeated. As such, unlike in the past, there is no need to provide the swing mechanism with any biasing means or a damper, so the space required for installing the components can be reduced when compared to that required in the past. In addition, because only tubular member 11 needs to be placed between root portions 12 and shaft support member 7 of the swing mechanism, the manufacturing cost can be reduced when compared to that of the conventional configuration that involved the biasing means and the damper. Furthermore, demands for the prevention of vibrations of various kinds attributable to different elevator structures and elevator speeds can be met, for example, by altering the hardness of the material of tubular member 11 so as to change the spring constant. Moreover, as the assembly becomes worn or deteriorated over years, only tubular member 11 needs to be replaced without disassembling, assembling, or adjusting the other peripheral parts, so the time spent for maintenance can be reduced.

According to this invention, because the polygonal outer peripheral surface is fitted to the polygonal inner peripheral surface, turning of tubular member 11 with respect to shaft support member 7 is restrained, and turning of root portion 12 with respect to said tubular member 11 is restrained; whereby, when the turning force is acted upon said shaft 8A, tubular member 11 is twisted and then returns to its original position subsequently.

According to this elevator device and the roller guide assembly, because the inner and the outer peripheral surfaces of root portion 12, tubular member 11, and shaft support member 7 are formed in the polygonal cross-sectional shape in order to configure the restraining means, the restraining means can be configured easily. Although shown in FIG. 2*a* as four-sided polygons, the root portion 12, tubular member 11, and shaft support member 7 could be a three-sided or five or more sided polygons.

When the combination of roller periphery 10, which could be made of rubber or urethane, and the hardness (spring constant) of tubular member 11 is adjusted, vibrations of car 1 can be restrained under ordinary condition due to the twisting and the restitution of tubular member 11; and in the event car 1 comes to a stop when an emergency stop device is activated, the impact to rollers 5*a*, 5*b*, and 5*c* is mitigated as roller peripheral parts 10 bend.

Figure 2:
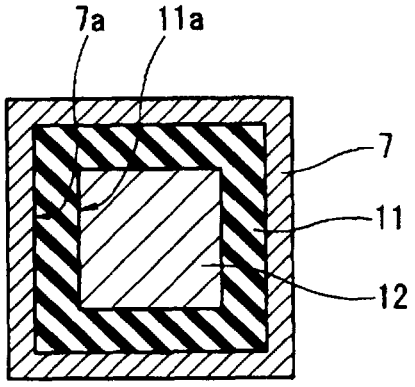
FIG. 2 (*a*) is a cross-sectional view of the swing mechanism of FIG. 1 showing one possible arrangement of a support part of a shaft, and (b) is a cross-sectional view showing another possible arrangement of a support part of a shaft.
Figure 2:
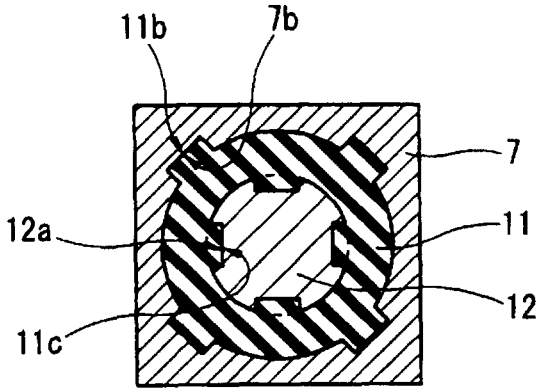

FIG. 2(*b*) provides another possible arrangement. Similar components from the aforementioned arrangement are assigned the same reference character and such features are provided without any explanation. Thus, only the different components from the aforementioned arrangement will be explained.

In particular, the configuration of the part that supports shaft 8A is different. As shown in FIG. 2(*b*), the outer peripheral surface of root portion 12, the inner peripheral surface of tubular member 11, and the inner peripheral surface of shaft support member 7 are formed in a circular cross-sectional shape.

As one possible alternative (and as specifically shown in FIG. 2(*b*)), one or more recesses 7*b* can be formed on inner peripheral surface of shaft support member 7. The recesses 7*b* could be positioned roughly at even intervals around the inner periphery of the shaft support member 7. Similarly, one or more projections 11*b* could extend from the outer peripheral surface of tubular member 11 in an integrated manner. As shown in FIG. 2(*b*), the recesses 11*a* and projections 11*b* can be complementary. Similarly, one or more recesses 12*a* are formed on outer peripheral surface of root portion 12. The recesses 12*a* could be positioned roughly at even intervals around the outer periphery of the root portion 12. Similarly, one or more projections 11*c* could extend from the inner peripheral surface of tubular member 11 in an integrated manner. As shown in FIG. 2(*b*), the projections recesses 12*a* and projections 11*c* can be complementary. The recesses 7*b*, 12*a* and projections 11*b*, 11*c* enhance the ability of the shaft support member 7 to restrain the shaft 8A from rotation. Although FIG. 2(*b*) shows four (4) recesses and projections between the shaft support member 7 and tubular member 11 and four (4) recesses and projections between the tubular member 11 and root portion 12, any number of recesses and projections could be used.

According to this invention, when projections 11*b* and 11*c* of tubular member 11 are fitted into recesses 7*b* and 12*a* of shaft support member 7 and root portion 12, turning of tubular member 11 with respect to shaft support member 7 is restrained, and turning of root portion 12 with respect to tubular member 11 is restrained; whereby, tubular member 11 is twisted when a turning force is acted upon said shaft 8A and subsequently returns to its original position.

According to this elevator device and the roller guide assembly, because the restraining means is configured by forming recesses 12*a* and 7*b* on the outer peripheral surface of root portion 12 of the shaft 8A and the inner peripheral surface of shaft support member 7, and by forming projections 11*b* and 11*c* on tubular member 11, the restraining means can be configured easily. Alternatively, the projections could extend from shaft support member 7 and shaft 8A, and the recesses could be on tubular member 11.

As another possible alternative (or in addition to the aforementioned projections 11*b* and 11*c* and the recesses 12*a* and 7*b*), an adhesive could be applied at one or more of the contact surfaces of root portion 12, tubular member 11, and shaft support member 7 so as to bond the respective members together in order to enhance the restraining capability of the arrangement.

According to this invention, because the respective members are joined together by the adhesive at the boundary parts, turning of tubular member 11 with respect to shaft support member 7 is restrained, and turning of root portion 12 with respect to tubular member 11 is restrained; whereby, tubular member 11 is twisted when a turning force is acted upon shaft 8A and subsequently returns to its original position.

According to this elevator device and the roller guide assembly, because the restraining means is configured by applying the adhesive at the boundary parts of root portion 12, tubular member 11, and shaft support member 7, the outer peripheral surface of root portion 12 and the inner peripheral surface of shaft support member 7 can be formed in a circular cross-sectional shape, which results in good workability. What is more, because the manufacturing cost is low due to the simple cylindrical shape of rubber 11, the manufacturing costs of the elevator device and the roller guide assembly are also low. Alternatively, however, the adhesive could be used on different shapes of tubular member 11, shaft support member 7 and root portion 12.

While the present invention has been particularly shown and described with reference to the exemplary embodiments as illustrated in the drawings, it will be recognized by those skilled in the art that various modifications may be made without departing from the spirit and scope of the invention as disclosed in the accompanying claims.

The invention claimed is:

1. An elevator system, comprising:

a car and/or a counterweight; and a roller guide assembly mounted to the car and/or counterweight, the roller guide assembly comprising:

a shaft including shaft root portion and a spindle, the spindle for supporting a roller for engaging a guide rail;

a shaft support member that receives the shaft root portion therein; and a member inserted between the shaft root portion and the aforementioned shaft support member, wherein the member limits the shaft root portion from turning relative to the shaft support member; wherein an exterior surface of the shaft root portion is restrained by an interior surface of the member and an exterior surface of the member is restrained by an interior surface of the shaft support member to limit rotation of the shaft root portion relative to the shaft support member;

wherein the member is positioned concentrically about the shaft root portion and the shaft support member is positioned concentrically about the member;

wherein the member is positioned concentrically about the shaft root portion around a common axis, the shaft support member is positioned concentrically about the member around the common axis and the member limits rotation of the shaft root portion relative to the shaft support member about the common axis.

2. The roller guide assembly described in claim 1; wherein, the member is tubular.

3. The roller guide assembly described in claim 2, wherein, the shaft root portion, the member, and the shaft support member are formed in a circular cross-sectional shape or a polygonal cross-sectional shape.

4. The roller guide assembly as described in claim 1, wherein one of the shaft root portion, the member, and the shaft support member includes one or more projections and another of the shaft root portion, the member, and the shaft support member includes one or more recesses to receive said one or more projections.

5. The roller guide assembly described in claim 1, wherein, the shaft root portion, member, and shaft support member are bonded together.

6. The roller guide assembly described in claim 1, wherein the roller guide assembly includes three rollers, and each roller includes a corresponding shaft root portion, shaft support member and member.

7. The roller guide assembly described in claim 1, wherein the roller guide assembly is mounted to a car of the elevator system.

8. The roller guide assembly described in claim 1, wherein the roller guide assembly is mounted to a counterweight of the elevator system.

* * * * *